US009145255B2

(12) United States Patent
Zagorsky

(10) Patent No.: US 9,145,255 B2
(45) Date of Patent: Sep. 29, 2015

(54) DISPENSER FOR DISPENSING A FLUENT MATERIAL

(71) Applicant: Eran Zagorsky, Porter Ranch, CA (US)

(72) Inventor: Eran Zagorsky, Porter Ranch, CA (US)

( * ) Notice: Subject to any disclaimer, the term of this patent is extended or adjusted under 35 U.S.C. 154(b) by 0 days.

(21) Appl. No.: 14/026,836

(22) Filed: Sep. 13, 2013

(65) Prior Publication Data

US 2015/0076179 A1 Mar. 19, 2015

(51) Int. Cl.
*B65D 83/66* (2006.01)

(52) U.S. Cl.
CPC ..... *B65D 83/666* (2013.01)

(58) Field of Classification Search
CPC ..... B05B 7/00; B05B 7/0012; B05B 7/0075; B05B 7/14; B05B 7/12; B05B 7/0416; B05B 7/0458; B05B 7/0491; B05B 7/1209; B05B 7/1236
USPC ..... 239/407, 412, 413, 416.2, 298
See application file for complete search history.

(56) References Cited

U.S. PATENT DOCUMENTS

2005/0279859 A1* 12/2005 Bhatia ..... 239/302
2008/0305420 A1* 12/2008 Kinoshita et al. ..... 430/97
2010/0176219 A1* 7/2010 Hasegawa ..... 239/407
2010/0270390 A1* 10/2010 Reitz ..... 239/8

* cited by examiner

*Primary Examiner* — Arthur O Hall
*Assistant Examiner* — Viet Le
(74) *Attorney, Agent, or Firm* — James A. Italia; Italia IP

(57) ABSTRACT

A dispenser for dispensing a fluent material, including a structural body including a fluid circuit for the thick fluent material and a pressure circuit for propelling and dispersing the thick fluent material. Thick fluent material is stored in a hopper and fed by gravity into the fluid circuit. The pressure circuit carrying for example compressed air branches into a first subcircuit arranged to propel thick fluent material towards the discharge nozzle, and a second subcircuit arranged to disperse the thick fluent material as it exists the discharge nozzle. First and second valves respectively control flow of pressurized air in the first and second subcircuits to independently adjust the rate of discharge and dispersion of the thick fluent material.

12 Claims, 1 Drawing Sheet

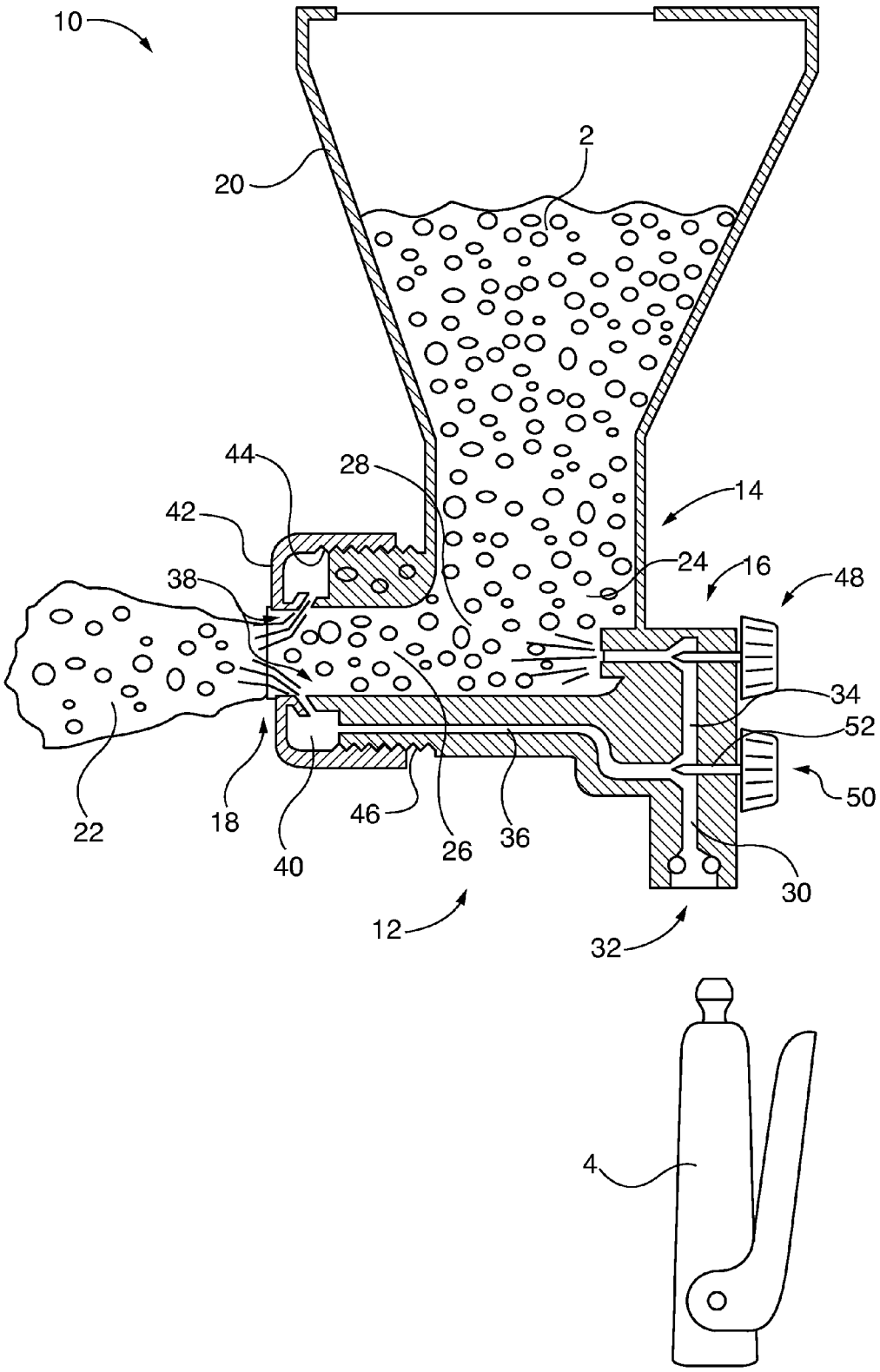
10
20
2
44
28
42
14
38
24
16
48
34
52
50
22
18
46
26
36
40
30
12
32
4

DISPENSER FOR DISPENSING A FLUENT MATERIAL

FIELD OF THE INVENTION

The present invention relates to a dispenser for dispensing fluent materials as a spray, the dispenser is particularly adapted to provide variable dispersion of sprayed dispensed material.

BACKGROUND OF THE INVENTION

Applying a coat of a fluent material entails several aspects. One is that the material must be susceptible to being spread over a broad area being coated. Another is that for esthetic reasons, it may be desirable to apply the coat as evenly as possible.

Fluent materials, particularly thick fluent cementitious materials such as stucco, may be dispensed by pneumatic equipment. However, achieving relatively fine control over the dispensed coat, as has been achieved with less viscous or thick materials such as paints, remains in need of apparatus which both propels the material from a dispenser, and also successfully disperses the material to achieve a thin, even coating on the surface being coated.

SUMMARY OF THE INVENTION

The present invention addresses the above stated need by providing a dispenser which can both discharge and also disperse thick, semifluid cementitious materials such as stucco in its wet, uncured form or any other highly viscous material.

A dispenser for dispensing a thick fluent material, including a structural body including a fluid circuit for the thick fluent material and a pressure circuit for propelling and dispersing the thick fluent material. Thick fluent material is stored in a hopper and fed by gravity into the fluid circuit. Alternatively, the material can also be continuously fed to the dispenser by any manner known in the art. The pressure circuit carrying for example compressed air branches into a first subcircuit arranged to propel thick fluent material towards the discharge nozzle, and a second subcircuit arranged to disperse the thick fluent material as it exits the discharge nozzle. First and second valves respectively control flow of pressurized air in the first and second subcircuits to independently adjust the rate of discharge and dispersion of the thick fluent material.

Compressed air impinges on the fluid circuit near the discharge nozzle from a ring shaped chamber surrounding the fluid circuit. The ring shaped air chamber is formed between the structural body and a cap which may thread to the structural body.

BRIEF DESCRIPTION OF THE DRAWINGS

Various objects, features, and attendant advantages of the present invention will become more fully appreciated as the same becomes better understood when considered in conjunction with the accompanying drawing, which is a side cross-sectional view of an apparatus according to the present invention.

DETAILED DESCRIPTION

The Drawing shows a dispenser 10 for dispensing a thick fluent material 2, according to at least one aspect of the invention. The thick fluent material 2 may be cementitious, such as stucco, and may contain fibers, thereby being more difficult to achieve flow and forming a suitable spray pattern than more liquid substances (not shown). The dispenser 10 includes a structural body 12. A fluid circuit 14 and a pressure circuit 16 are formed mostly within the structural body 12. The fluid circuit 14 terminates in a discharge nozzle 18 supported on the structural body 12. A supply hopper 20 which stores a supply of the thick fluent material 2 is fixed to and supported above the structural body 12 in the normal position of use, which is that depicted in the Drawing. Alternatively, the fluent material 2 can be continuously fed to the dispenser 10 using any known manner known in the art. In the normal position of use, the supply hopper 20, discharges vertically downwardly towards the structural body 12. The discharge nozzle 18 discharges horizontally. It should be mentioned here that orientational terms such as vertical, horizontal, downwardly, and the like, refer to the subject matter as depicted in the Drawing, which shows the subject matter in conditions and position of ordinary use. Discharged dispersed thick fluent material is indicated by the reference numeral 22.

The fluid circuit 14 includes a vertical inlet passage 24 wherein the thick fluent material 2 descends vertically by gravity from the supply hopper 20, and a discharge passage 26 which conducts the thick fluent material 2 horizontally towards the discharge nozzle 18. The fluid circuit forms a bend 28 which makes transition in the direction of flow of the thick fluent material 2 from vertical flow in the vertical inlet passage 24 to horizontal flow in the discharge passage 26.

A pressure circuit 30 both propels the thick fluent material 2 through the fluid circuit 14 and also disperses the thick fluent material 2 as the thick fluent material 2 is discharged through the discharge nozzle 18. The pressure circuit includes an inlet 32 for receiving pressurized air such as compressed air from an external source. The external source may be an air compressor, represented by a controllable pneumatic nozzle 4. The pressure circuit 30 branches into a first subcircuit 34 arranged to deliver pressurized air from the inlet 32 into the fluid circuit 14 at the bend 28, in a direction facing the discharge nozzle 18, and a second subcircuit 36 arranged to deliver pressurized air from the inlet 30 into the fluid circuit 14 proximate the discharge nozzle 18.

The second subcircuit 36 is configured to deliver pressurized air at a plurality of points 38 located circumferentially around the discharge passage 26. The points 38, of which two are shown and which may include additional points (not shown), impinge on the discharge passage 26 from a generally ring shaped chamber 40 configured to surround the discharge passage 26. The chamber 40 is formed between a cap 42 and the structural body 12. The cap 42 may be configured to be coupled to and removable from the structural body 12, having threads 44 which mate with threads 46 of the structural body 12.

A first valve 48 controls pressurized air in the first subcircuit 34. A second valve 50 controls flow of pressurized air in the second subcircuit. The valves 48, 50 may each comprise a shaft (e.g., the shaft 52 of the second valve 50) which threads into the structural body 12. The shaft 52 is configured to cooperate with a corresponding seat so as to entirely shut off flow at one limit of travel. The first valve 48 and the second valve 50 are each manually controllable to regulate flow continuously from no flow to a maximum flow. This enables independent adjustment of assist to propulsion of the thick fluent material 2 by the first subcircuit 34, and of dispersion of the thick fluent material 2 by the second subcircuit 36. Adjustment of both propulsion and dispersion may accommodate variation of thickness, viscousness, and other characteristics of the thick fluent material 2 which affect flowability and dispersion characteristics.

In addition, fluent material that is not of a generally thick nature such as paint could also be dispensed by the present device. In this case, the need for pressurized air from the first subcircuit 34 may be minimized or completely unnecessary. In this case, the first valve 48 may be fully or partially closed and the dispenser would still competently dispense less viscous materials.

The dispenser 10 may be hand held and used generally in the manner of a paint spray gun (not shown). With the first and second subcircuits 34, 36 adjusted appropriately for the specific thick fluent material 2 being applied to a surface (not shown), the surface can be provided with a coating of desired thickness, having a relatively even surface. Hence secondary working of the applied coating, such as using a trowel (not shown), may not be necessary.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A dispenser for dispensing a fluent material, comprising:
a structural body;
a discharge nozzle supported on the structural body;
a supply hopper integrated to and above the structural body when the discharge nozzle discharges horizontally, for storing a supply of the fluent material;
a fluid circuit having an vertical inlet passage wherein fluent material descends generally vertically by gravity from the supply hopper, a discharge passage which conducts the fluent material generally horizontally towards the discharge nozzle, and a bend which makes transition in the direction of flow of the fluent material from vertical flow in the vertical inlet passage to horizontal flow in the discharge passage;
a pressure circuit including an inlet for receiving pressurized air from an external source, a first subcircuit arranged to deliver pressurized air from the inlet into the fluid circuit at the bend, in a direction facing the discharge nozzle, and a second subcircuit arranged to deliver pressurized air from the inlet into the fluid circuit proximate the discharge nozzle;
a first valve disposed to control flow of pressurized air in the first subcircuit; and
a second valve disposed to control flow of pressurized air in the second subcircuit, wherein the first and second valves allow for true independent adjustment of each valve such that the first valve controls a range from zero to one hundred percent flow of pressurized air in the first subcircuit and the second valve controls a range from zero to one hundred percent flow of pressurized air in the second subcircuit and the first subcircuit, wherein said first and second valves are aligned along a vertically linear axis perpendicular to a discharge axis of the nozzle, and wherein said first and second valves can be set at any flow rate between zero to one hundred percent.

2. The dispenser of claim 1, wherein the second subcircuit is configured to deliver pressurized air at a plurality of points located circumferentially around the discharge passage.

3. The dispenser of claim 1, wherein the second subcircuit includes a ring shaped chamber configured to surround the discharge passage.

4. The dispenser of claim 3, further comprising a cap configured to be coupled to and removable from the structural body, wherein the ring shaped chamber is formed between the cap and the structural body.

5. The dispenser of claim 1, wherein the first valve and the second valve are each manually controllable to regulate flow continuously from no flow to a maximum flow.

6. A dispenser for dispensing a fluent material, comprising:
a structural body;
a discharge nozzle supported on the structural body;
an inlet passage arranged in the structural body for receiving fluent material;
a fluid circuit wherein fluent material descends from said inlet passage, a discharge passage which conducts the fluent material generally horizontally towards the discharge nozzle;
a pressure circuit including an inlet for receiving pressurized air from an external source, a first subcircuit arranged to deliver pressurized air from the inlet into the fluid circuit in a direction facing the discharge nozzle, and a second subcircuit arranged to deliver pressurized air from the inlet into the fluid circuit proximate the discharge nozzle;
a first valve disposed to control flow of pressurized air in the first subcircuit; and
a second valve disposed to control flow of pressurized air in the second subcircuit, wherein the first and second valves allow for true independent adjustment of each valve such that the first valve controls a range from zero to one hundred percent flow of pressurized air in the first subcircuit and the second valve controls a range from zero to one hundred percent flow of pressurized air in the second subcircuit and the first subcircuit, wherein said first and second valves are aligned along a vertically linear axis perpendicular to a discharge axis of the nozzle, and wherein said first and second valves can be set at any flow rate between zero to one hundred percent.

7. The dispenser of claim 6, wherein the second subcircuit is configured to deliver pressurized air at a plurality of points located circumferentially around the discharge passage.

8. The dispenser of claim 6, wherein the second subcircuit includes a ring shaped chamber configured to surround the discharge passage.

9. The dispenser of claim 8, further comprising a cap configured to be coupled to and removable from the structural body, wherein the ring shaped chamber is formed between the cap and the structural body.

10. The dispenser of claim 6, wherein the first valve and the second valve are each manually controllable to regulate flow continuously from no flow to a maximum flow.

11. The dispenser of claim 1, wherein said first and second valves each include a shaft which threads into said structural body.

12. The dispenser of claim 6, wherein said first and second valves each include a shaft which threads into said structural body.

* * * * *